US006742232B2

(12) United States Patent
Kussius

(10) Patent No.: US 6,742,232 B2
(45) Date of Patent: Jun. 1, 2004

(54) RAIL WHEEL SET EXTRACTOR

(76) Inventor: John F. Kussius, 18 Dick Lynch Rd., Stillwater, NY (US) 12170

( * ) Notice: Subject to any disclaimer, the term of this patent is extended or adjusted under 35 U.S.C. 154(b) by 126 days.

(21) Appl. No.: 09/999,715

(22) Filed: Oct. 31, 2001

(65) Prior Publication Data

US 2003/0079328 A1 May 1, 2003

(51) Int. Cl.[7] ..... B66F 9/12
(52) U.S. Cl. ..... 29/244
(58) Field of Search ..... 414/427, 607; 187/237; 29/244, 281.5; 269/17, 296, 130–132; 254/133, 134

(56) References Cited

U.S. PATENT DOCUMENTS

| | | | | | |
|---|---|---|---|---|---|
| 1,892,979 | A | | 1/1933 | Clark | |
| 2,447,435 | A | | 8/1948 | Settle | |
| 2,483,908 | A | | 10/1949 | Jackson | |
| 2,494,099 | A | | 1/1950 | Mandelko et al. | |
| 2,640,604 | A | * | 6/1953 | Curley | 414/427 |
| 2,692,694 | A | | 10/1954 | Goldstein | |
| 2,807,380 | A | | 9/1957 | Boehnke | |
| 2,877,912 | A | | 3/1959 | Di Giacomo | |
| 3,501,037 | A | * | 3/1970 | Donovan | 414/427 |
| 5,692,583 | A | * | 12/1997 | Reed et al. | 187/237 |

* cited by examiner

*Primary Examiner*—Robert C. Watson
(74) *Attorney, Agent, or Firm*—Schmeiser, Olsen & Watts

(57) ABSTRACT

A rail wheel set extractor apparatus and method for extracting, transporting, and installing rail wheel sets is disclosed. The apparatus has a frame with a support system adapted to straddle a rail wheel of a rail wheel set. The apparatus includes an attachment system which is adapted to operatively attach the frame to the rail wheel and a member which prevents rotation and movement of the rail wheel.

15 Claims, 16 Drawing Sheets

RAIL WHEEL SET EXTRACTOR

FIELD OF INVENTION

This invention relates generally to the field of rail vehicle maintenance and repairs. More particularly, this invention provides an apparatus and method for extracting, transporting, and installing rail wheel sets on any vehicle which has rail wheels.

BACKGROUND OF INVENTION

A rail wheel set typically connotes the combination of two opposing rail wheels, the two rail wheel bearings, and the wheels' shared axle on any type of rail wheel vehicle. Rail wheels, bearings, and rail wheel sets require frequent repair, replacement, scheduled maintenance, and inspection. Frequently, whether it is the tread of the wheels, the flange of the wheels, the bearings at either end of the axle, or other parts of the rail wheel set, these elements all receive much wear and are even known to be the cause of rail derailments if not properly maintained. In order to inspect, maintain, repair, or replace a rail wheel set, the rail wheel set must be removed and extracted from the rail car to which it is attached.

On a typical freight box-car there are four rail wheel sets; two fore and two aft. Two rail wheel sets are combined on to one rail truck. Each truck is attached to the underside of a rail car at a center plate which resides at the center of a truck bolster. Currently, in order to extract and change a rail wheel set from a rail car there are several steps required, resulting in significant time, cost and resources expended. The current steps to remove a rail wheel set from a rail car include disconnecting the rail truck from the rail car. The rail car is then lifted off and above the disconnected rail truck. The entire rail truck is then rolled out from under the raised rail car. The rail wheel set which requires replacement is then disconnected from the rail truck. The rail truck is then jacked up or lifted off and above the disconnected rail wheel set. The rail truck needs to be lifted high enough so that the full height of the truck frame sides entirely clear the wheel set. The disconnected rail wheel set which requires replacement is then taken away for maintenance, inspection, repair, changing, etc. The rail wheel set is lifted and transported via a chain or sling arrangement tied around the wheel set axle, usually by a piece of mobile equipment. A new rail wheel set is installed essentially by reversing the aforementioned steps.

Accordingly, there is a need for a method of extracting, transporting, and reinstalling a rail wheel set which obviates the above-referenced problems associated with currently used rail wheel set extraction methods.

SUMMARY OF INVENTION

The present invention provides an apparatus and method for extracting, changing, transporting, and installing a rail wheel set without removing the truck from under the rail car.

A first general aspect of the invention provides an apparatus for extracting a rail wheel set comprising:

- a frame with a support system adapted to straddle a bottom portion of a rail wheel of the rail wheel set;
- an attachment system adapted to operatively attach the frame to the rail wheel; and
- a member adapted to prevent rotation and movement of the rail wheel.

A second general aspect of the invention provides an apparatus comprising:

- a frame with at least one hook attached thereto for hooking a rim of a rail wheel;
- at least two side arms adapted to straddle a bottom portion of the rail wheel; and,
- a center wheel member engageable with a face on a lower center portion of the rail wheel.

A third general aspect of the invention provides a method for extracting rail wheel sets from a rail car comprising the steps of:

- placing a rail wheel set extractor adjacent to a rail wheel of a rail wheel set;
- placing a support system adapted to straddle bottom portion of the rail wheel under the rail wheel;
- engaging a member against a face of the rail wheel; and,
- attaching a holding device to a rim of the rail wheel.

A fourth general aspect of the invention provides an apparatus for extracting a rail wheel set comprising:

- a frame attached to a lifting device;
- a grabbing system attached to the frame for grabbing a rim on a rail wheel of the rail wheel set;
- two side arms adapted to straddle a bottom portion of the rail wheel; and,
- a center wheel locking member engageable with a face of the rail wheel.

The foregoing and other features of the invention will be apparent from the following more particular description of various embodiments of the invention.

BRIEF DESCRIPTION OF DRAWINGS

Some of the embodiments of this invention will be described in detail, with reference to the following figures, wherein like designations denote like members, wherein.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention, the drawings are not necessarily drawn to scale.

Figure 3:
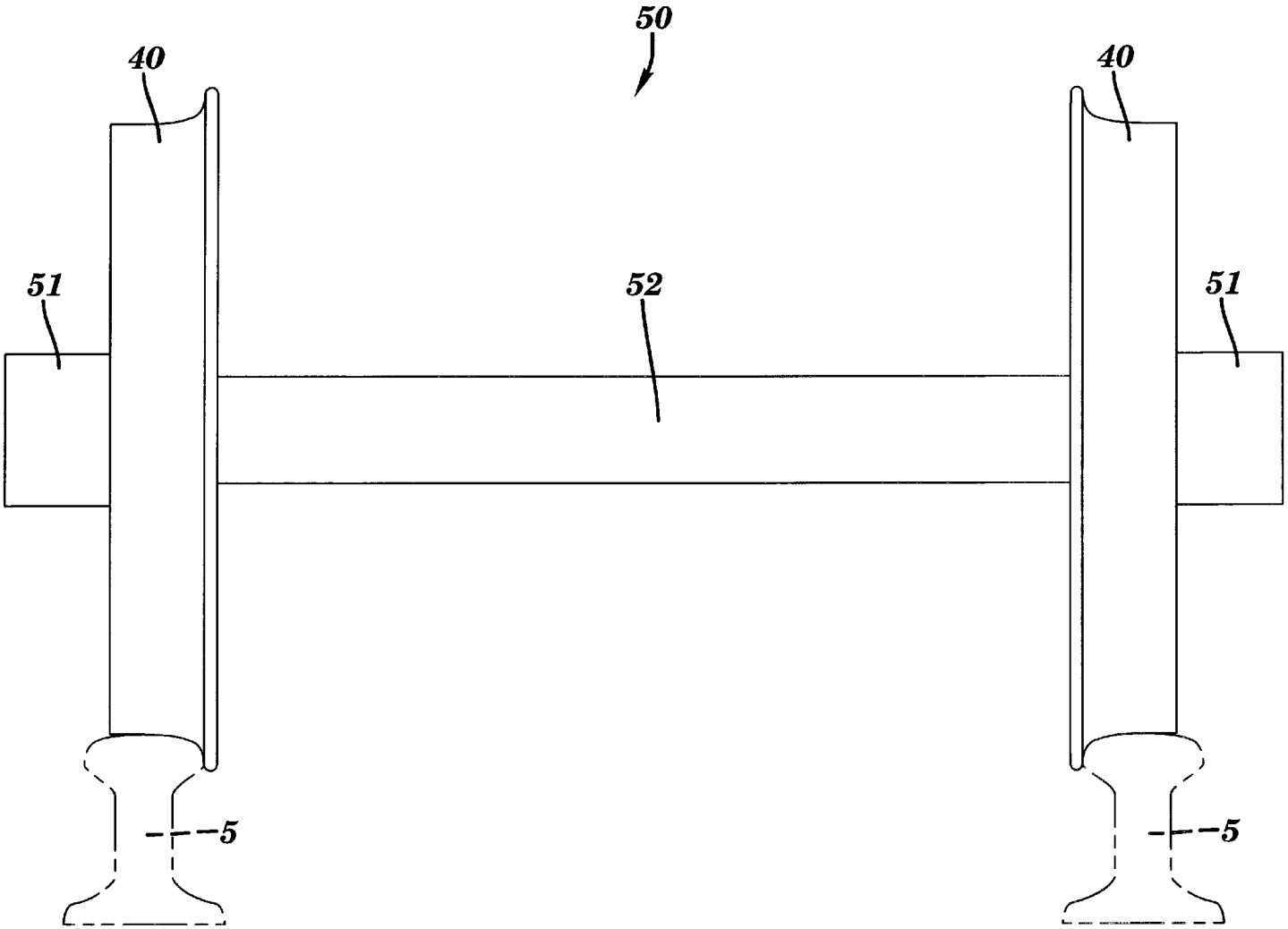
FIG. 3 depicts a side view of a typical rail wheel set.

Referring to the drawings, FIG. 3 depicts a rail wheel set 50 which typically connotes the combination of two opposing rail wheels 40, two wheel bearings 51, and their shared axle 52. The two rail wheels 40 rest or ride on two rails 5 (shown in phantom).

Figure 1:
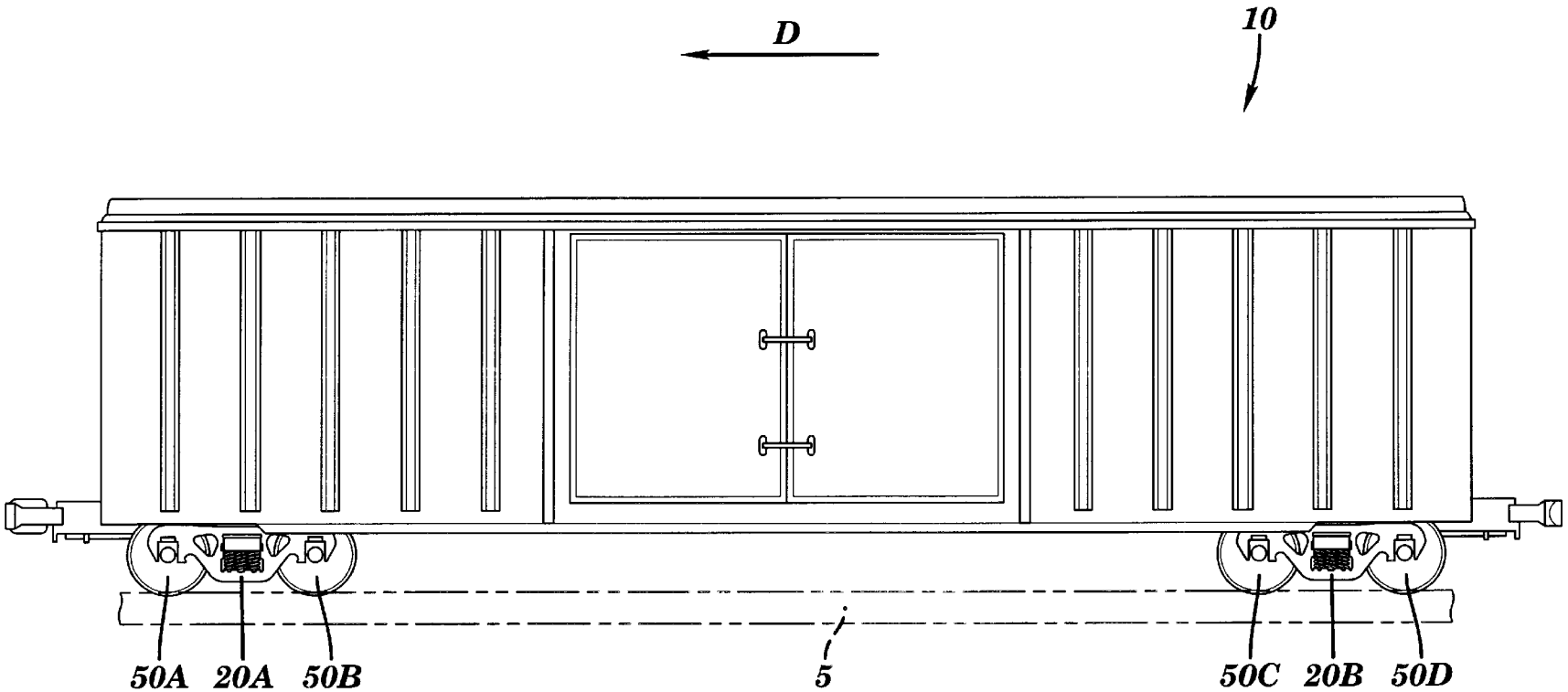
FIG. 1 depicts a side view of a typical freight box-car.

FIG. 1 depicts a side view of a typical freight box-car. As shown in FIG. 1 the typical freight box-car 10 has four rail wheel sets 50 (e.g., 50A, 50B, 50C, 50D); two fore and two aft. Two rail wheel sets 50A, 50B (i.e., four rail wheels 40) are combined on to one rail truck 20A and the two other rail wheel sets 50C, 50D (i.e., four rail wheels 40) are combined on to a second rail truck 20B. The rail car 10 typically has a truck 20 at both ends of the rail car 10. The rail wheel sets 50 of the rail car 10 rest on a set of rails 5 (shown in phantom). Moving in the direction of travel (denoted by directional arrow "D"), the rail car 10 has a leading truck 20A and a trailing truck 20B. The leading truck 20A has a leading wheel set 50A and a trailing wheel set 50B. Likewise, the trailing truck 20B has a leading wheel set 50C and a trailing wheel set 50D. Other rail vehicles, such as locomotives, heavy duty rail cars, or intermodal freight cars, have different truck 20, wheel set 50, and wheel 40 configurations than the typical combination of: two trucks 20 per rail car 10; and, two wheel sets 50 per truck 20 as outlined for the typical freight box-car above. For example, several locomotives have three or more wheel sets 50 per truck 20, as well as, more than just two trucks 20 per rail vehicle 10. Contrastingly, other rail vehicles may have only one wheel set 50 per truck 20 or only one truck per rail vehicle 10.

Figure 2:
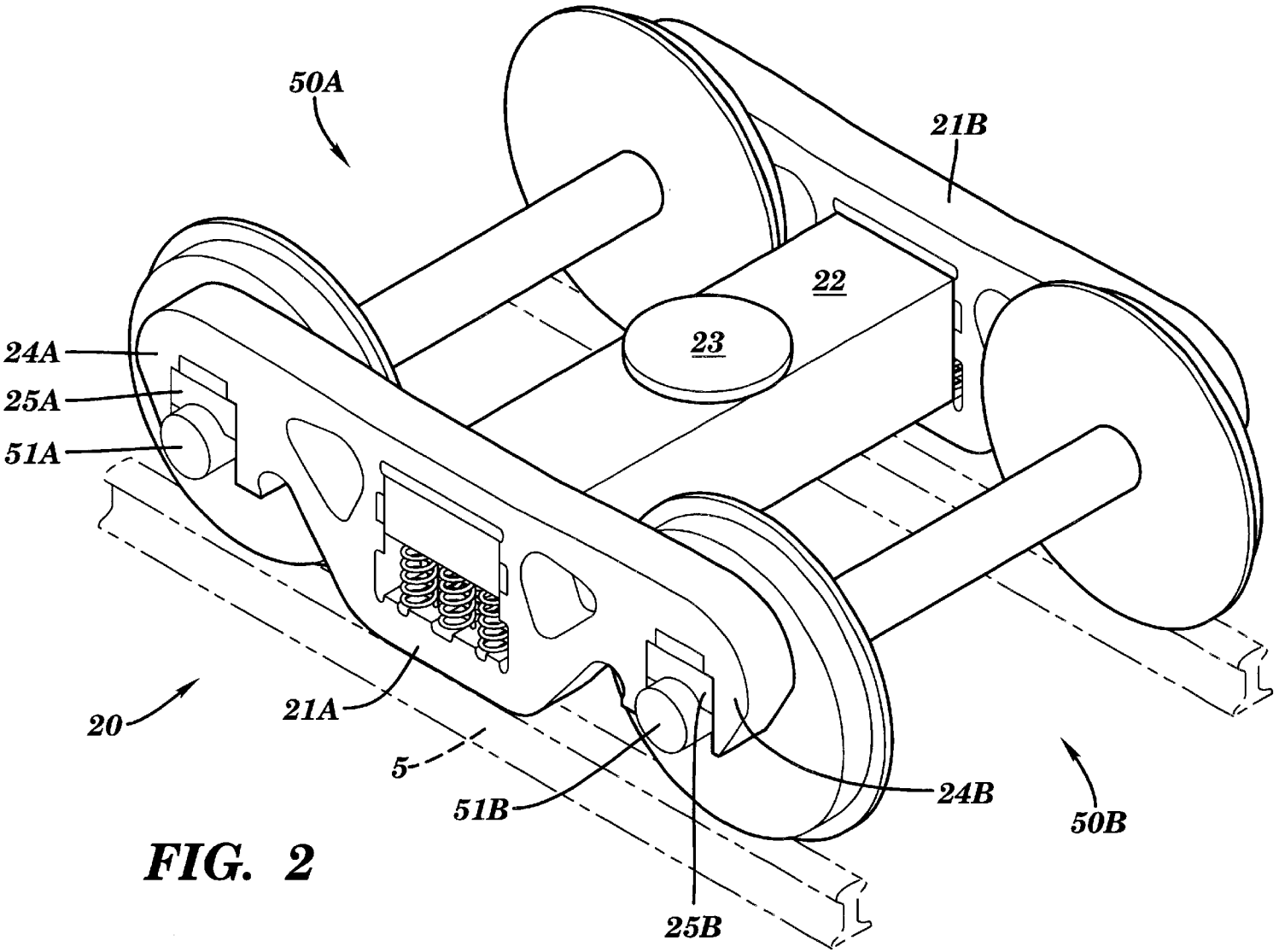
FIG. 2 depicts a perspective view of a typical rail truck.

FIG. 2 depicts a perspective view of a typical rail truck 20 and some of its typical parts. A truck 20, which holds two wheel sets 50 (i.e., 50A, 50B), is typically an I-shaped frame made up of two truck side frames 21 (e.g., 21A, 21B) joined together by a truck bolster 22. The entire truck 20 is attached to the underside of a rail car 10 via a center plate 23, which resides in the middle of the truck bolster 22. The two wheel sets 50A, 50B are attached to the truck sides 21A, 21B at the wheel bearing 51A, 51B. The two wheel sets 50A, 50B rest on a two rails 5 (shown in phantom). An adapter 25 (e.g., 25A, 25B) is spaced between the wheel bearings 51A, 51B and the truck side frame 21A. An adapter 25 is also spaced between each of the two wheel bearings 51 and the truck side frame 21B on the other side of the truck 20 (not shown). A projection-like leg of the truck side frame 21A that keeps the wheel sets 50 in place with the truck 20 is called the truck pedestal 24 (e.g., 24A, 24B). The other truck side frame 21B also includes similarly shaped truck pedestals 24 (not shown) keeping the wheel sets 50 in place on the other side of the truck 20.

Figure 4:
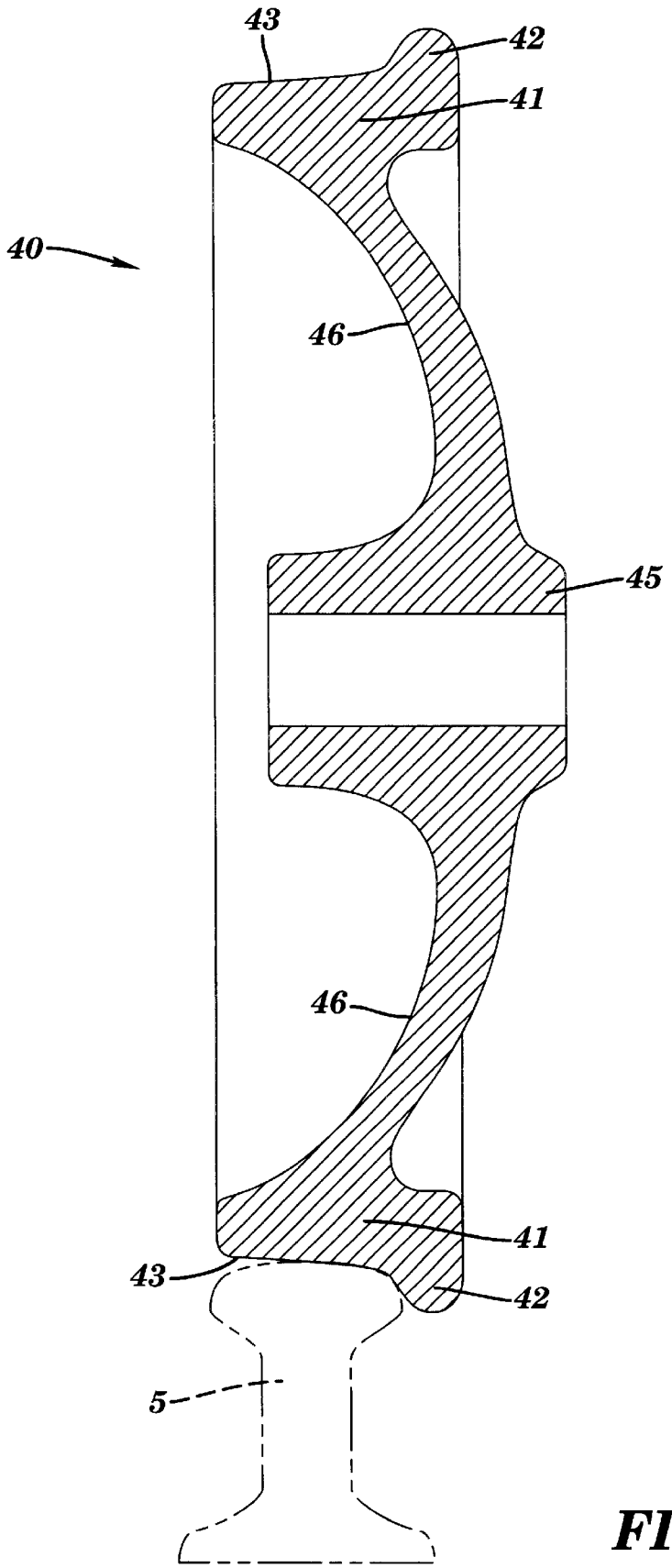
FIG. 4 depicts a cross-section view of a typical rail wheel.

FIG. 4 depicts a cross-section of a typical rail wheel 40. The axle (not shown) is centered in the hub 45 of the rail wheel 40. The area of the wheel 40 between the hub 45 and the outer perimeter of the wheel 40 is the plate, fillet or face 46 of the wheel 40. The outer perimeter of the wheel 40 is the rim 41. The lip-like projection on the rim 41 is the flange 42 which prevents the rail wheel 40 from going off a rail or track 5 (shown in phantom). The tread 43 is the portion of the rim 41 that physically contacts the rail or track 5 while the wheel 40 is rolling on a rail or track 5.

Figure 5:
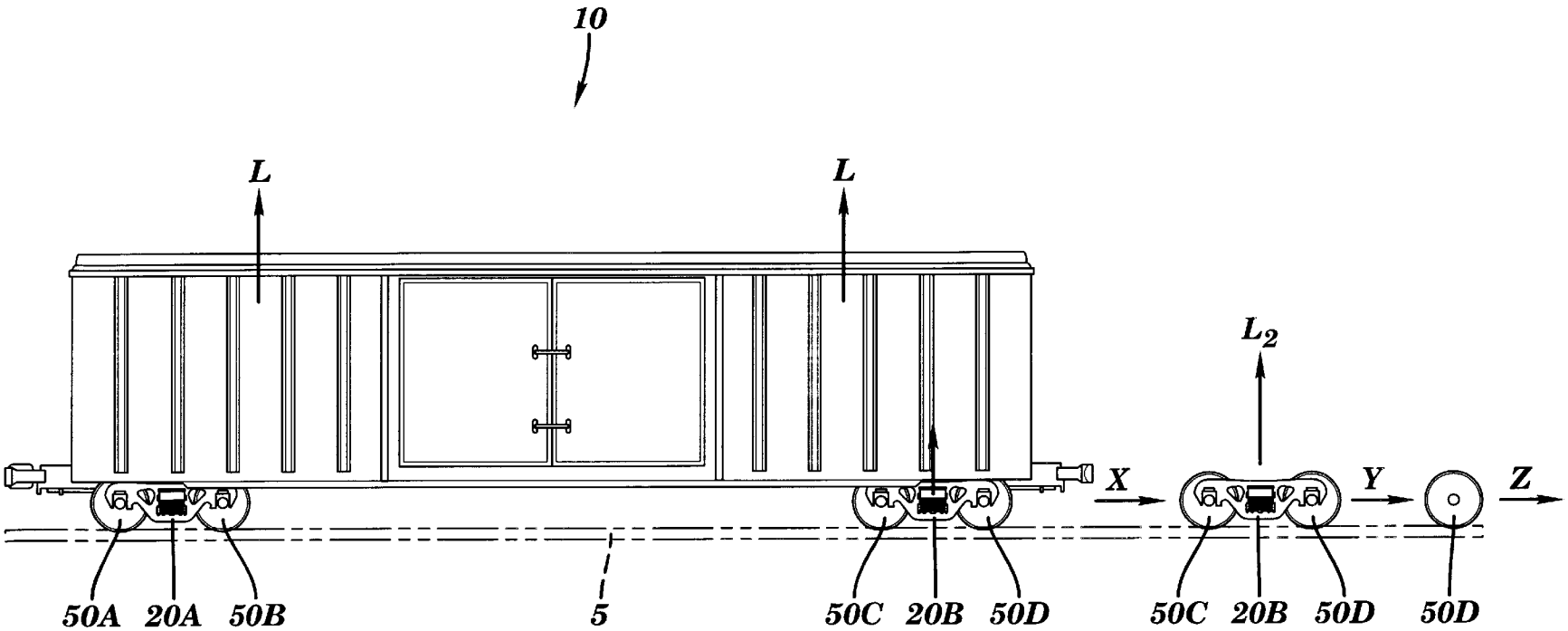
FIG. 5 depicts a side view of the typical steps for removing a rail wheel set from a freight box-car, in accordance with the related art.

Currently, in order to remove and change a rail wheel set 50 from a rail car 10 several steps are generally required, resulting in significant time, cost and resources expended. FIG. 5 depicts a side view of the typical steps for removing a rail wheel set from a freight box-car, in accordance with the related art. The steps typically used to extract a rail wheel set 50 from a rail car 10 include disconnecting a rail truck (e.g., 20B) from the rail car 10 at the center plate (not shown). The rail car 10 is then lifted off and above the disconnected rail truck 20B and the rail 5 (denoted by directional arrows "L"). The disconnected, complete rail truck 20*b* is then rolled out from under the raised rail car 10 (denoted by directional arrow "X"). The rail wheel set 50D which requires replacement is then disconnected from the rail truck 20B. The rail truck 20B is then jacked up or lifted off and above the disconnected rail wheel set 50D (denoted by directional arrow "$L_2$". The rail truck 20B must be lifted to such a height so that the full height of the side of the truck 20B clears the wheel set 50D. Wheel set 50D is then rolled out from under, and away from, truck 20B (denoted by directional arrow "Y"). The wheel set 50D that requires replacement is then taken away for maintenance, inspection, repair, changing, etc. (denoted by directional arrow "Z"). Frequently, the rail wheel set 50D is lifted and carried via a chain or sling arrangement tied or wrapped around the rail axle 52 (not shown). Usually a boom truck or other piece of mobile equipment is used to move the rail wheel set 50D once wrapped in the sling. A new rail wheel set 50 is installed essentially by reversing the aforementioned steps.

An alternative method currently employed for removing rail wheel sets 50 is to disconnect the desired rail wheel set 50 from a truck 20. Then the rail car 10 and attached truck 20 are lifted or jacked to a full height such that the freed rail wheel set 50 clears vertically the complete side frame 21 of the trucks 20. Once cleared, the rail wheel set 50 is lifted and carried by a piece of mobile equipment as in the method mentioned above.

Figure 6:
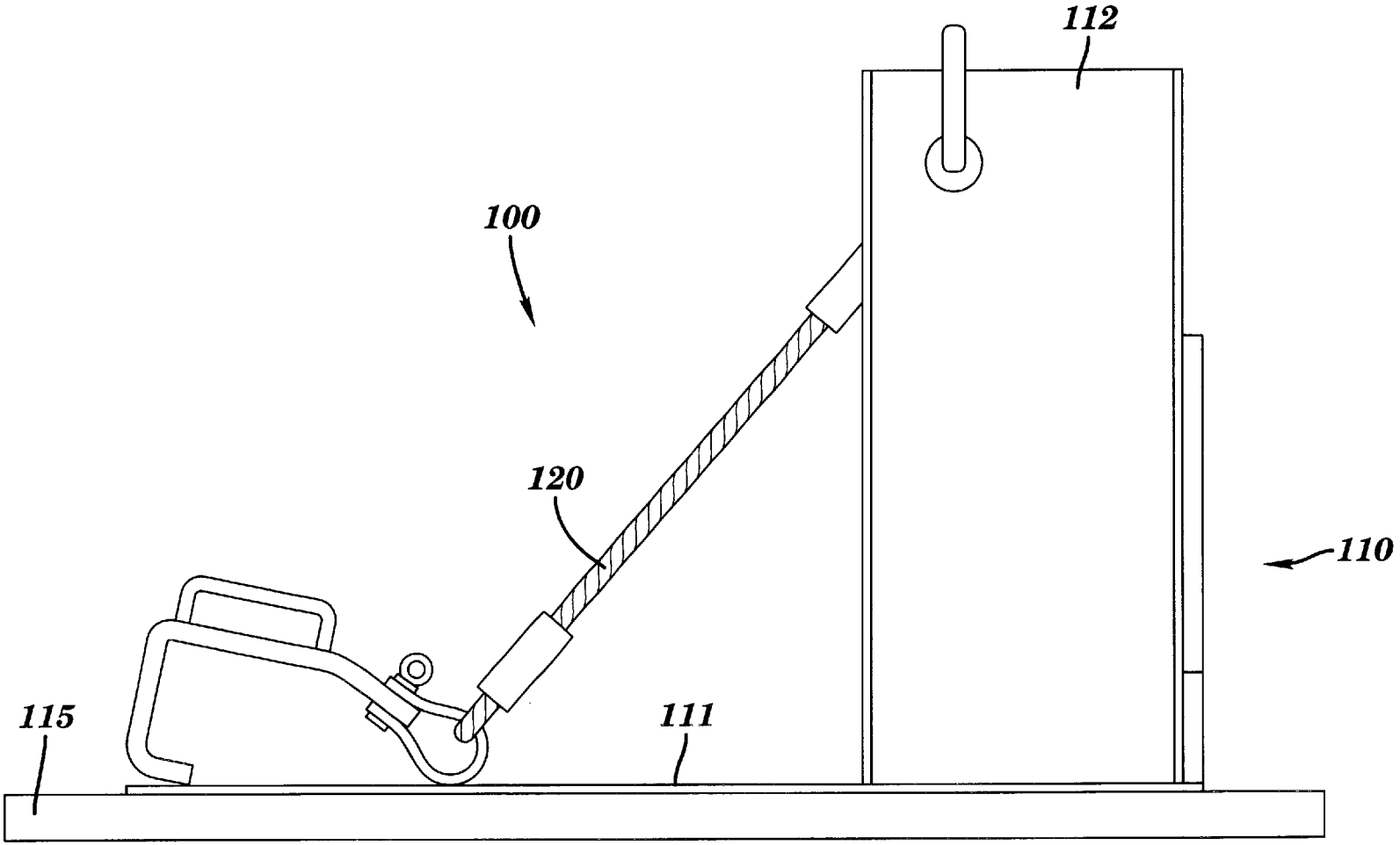
FIG. 6 depicts a side view of a rail wheel set extractor apparatus, in accordance with the present invention.

FIG. 6 depicts a side view of a rail wheel set extractor apparatus 100, in accordance with the invention. The rail wheel set extractor apparatus 100 is made up of a frame 110 and a hook-cable-connecting pin sub-assembly 120. The hook-cable-connecting pin sub-assembly 120 is connected to the frame 110 on the uprights 112 of the frame 110. The frame 110 has a base plate 111 and two uprights 112. In the shown embodiment, connected to the underside of the base plate 111 are two fork-lift tubes 115 for receiving the forks from a fork-lift or any other lifting device or piece of lifting equipment. The fork-lift or other lifting device allows the rail wheel set apparatus 100 to be transported and lifted.

Figure 7:
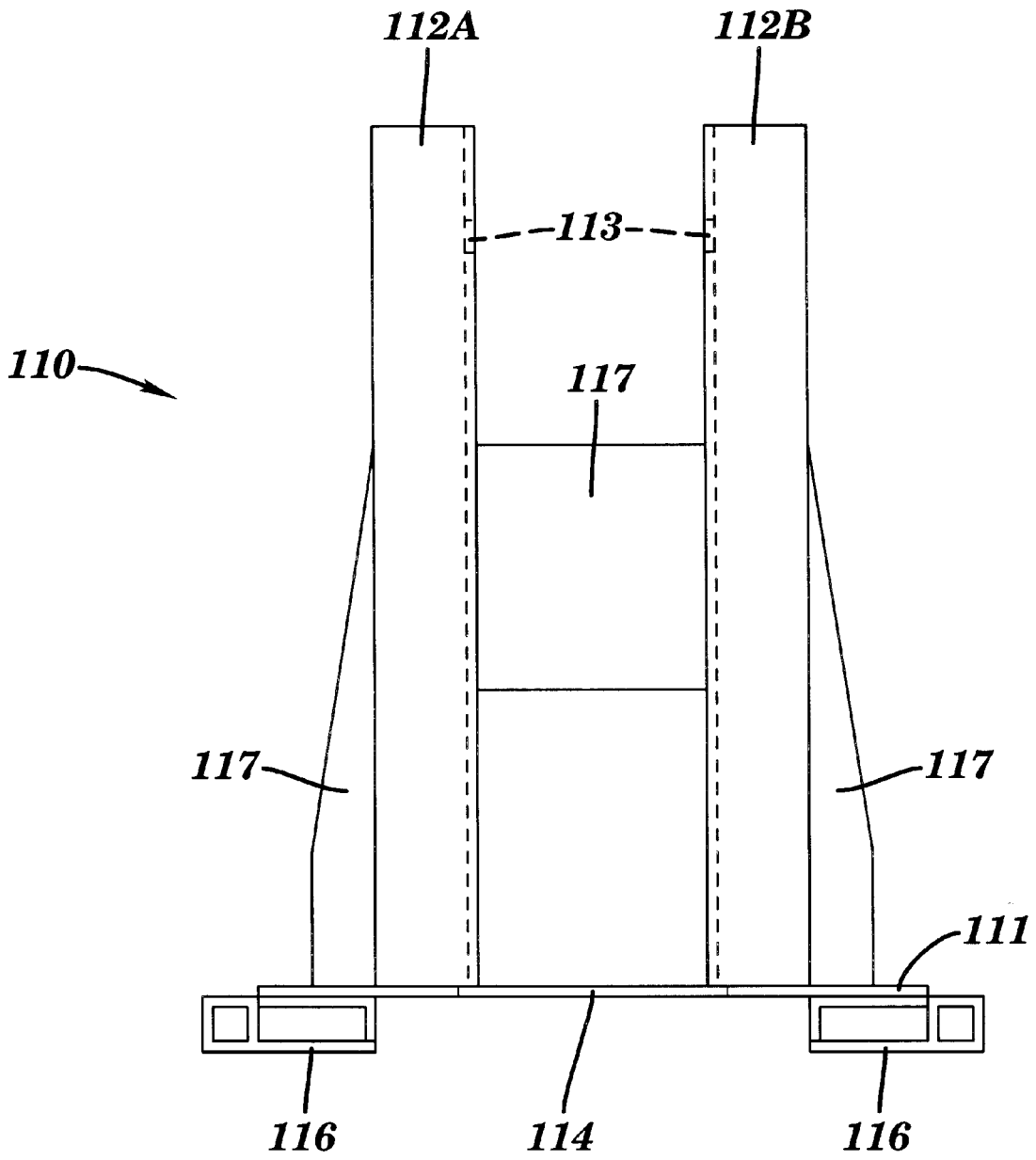
FIG. 7 depicts a front view of a rail wheel set extractor apparatus without the hook-cable-connecting pin sub-assembly shown, in accordance with the present invention.

FIG. 7 depicts a front view of the frame 110, without the hook-cable-connecting pin sub-assembly 120 shown, of the rail wheel extractor apparatus 100, in accordance with the present invention. The front view of FIG. 7 is from the vantage point of a rail wheel set 50. The base plate 111 of the frame 110 has two uprights 112 (e.g., 112A, 112B). Due to the heavy weight of rail wheels 40 and rail wheel sets 50, various bracing 117 can be added between the two uprights 112A, 112B and the base plate 111 and in other locations to increase the strength and rigidity of the rail wheel set extractor apparatus 100. On the upper ends of the uprights 112A, 112B there are transverse holes 113 for receiving a connecting pin 124 (see FIG. 9) from the hook-cable-connecting pin sub-assembly 120. One, or both, of the two holes 113 can have a key-notch which matches a corresponding key on the connecting pin 124 to ensure accurate placement of the connecting pin 124 within the holes 113 and to prevent rotation of the connecting pin 124. Other systems for preventing rotation of the connecting pin 124 and for ensuring that the connecting pin 124 be adequately and accurately placed may be used. In the center of the base plate 111, and integral thereto, is a center member 114. Two lifting side arms 116 extend from the front of the base plate 111.

Figure 8:
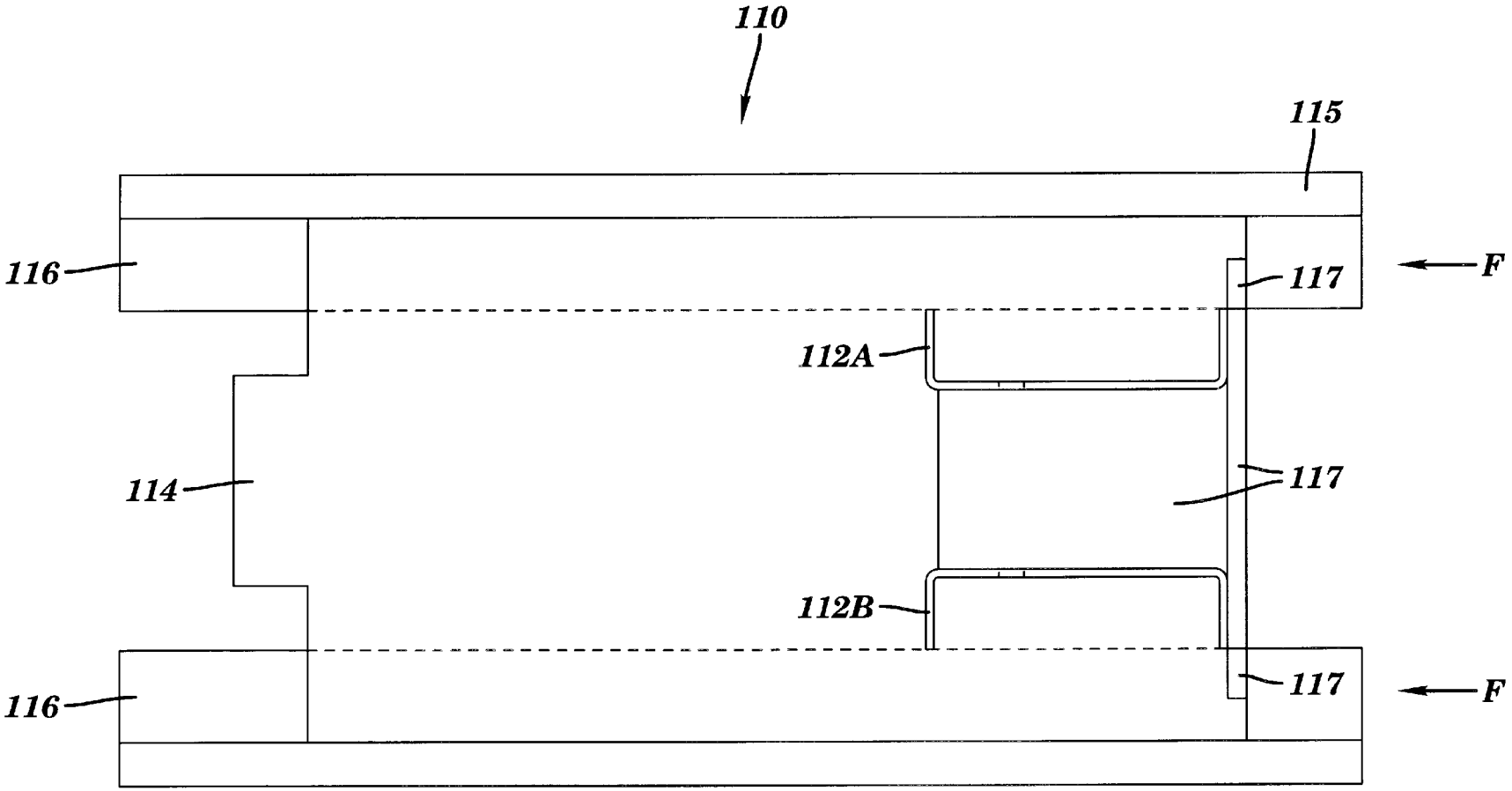
FIG. 8 depicts a top view of a rail wheel set extractor apparatus without the hook-cable-connecting pin sub-assembly shown, in accordance with the present invention.

FIG. 8 depicts a top view of the frame 110 of the rail wheel extractor apparatus 100, in accordance with the invention. Again, the hook-cable-connecting pin sub-assembly 120 is not shown for clarity purposes. Extending vertically from the base plate 111 are the two uprights 112A, 112B. Both between the uprights 112A, 112B and behind the uprights 112A, 112B bracing 117 may be added to strengthen the connection between the uprights 112 and the base plate 111 and elsewhere. On either side of the base plate 111 are the two fork-lift tubes 115. Forks 131 (see FIG. 15) from a fork lift 130 can be inserted in the fork lift tubes 115 (denoted by directional arrows "F") in order to provide a lifting and transverse force. On the front end of the base plate 111 are the two side arms 116. The side arms 116 provide a support system to the rail wheel 40 and thus are spaced accordingly. The side arms 116 in the shown embodiment are built integral to the fork lift tubes 115. Centered between the two side arms 116 and integral to the base plate 111 is the center member 114.

Figure 9:
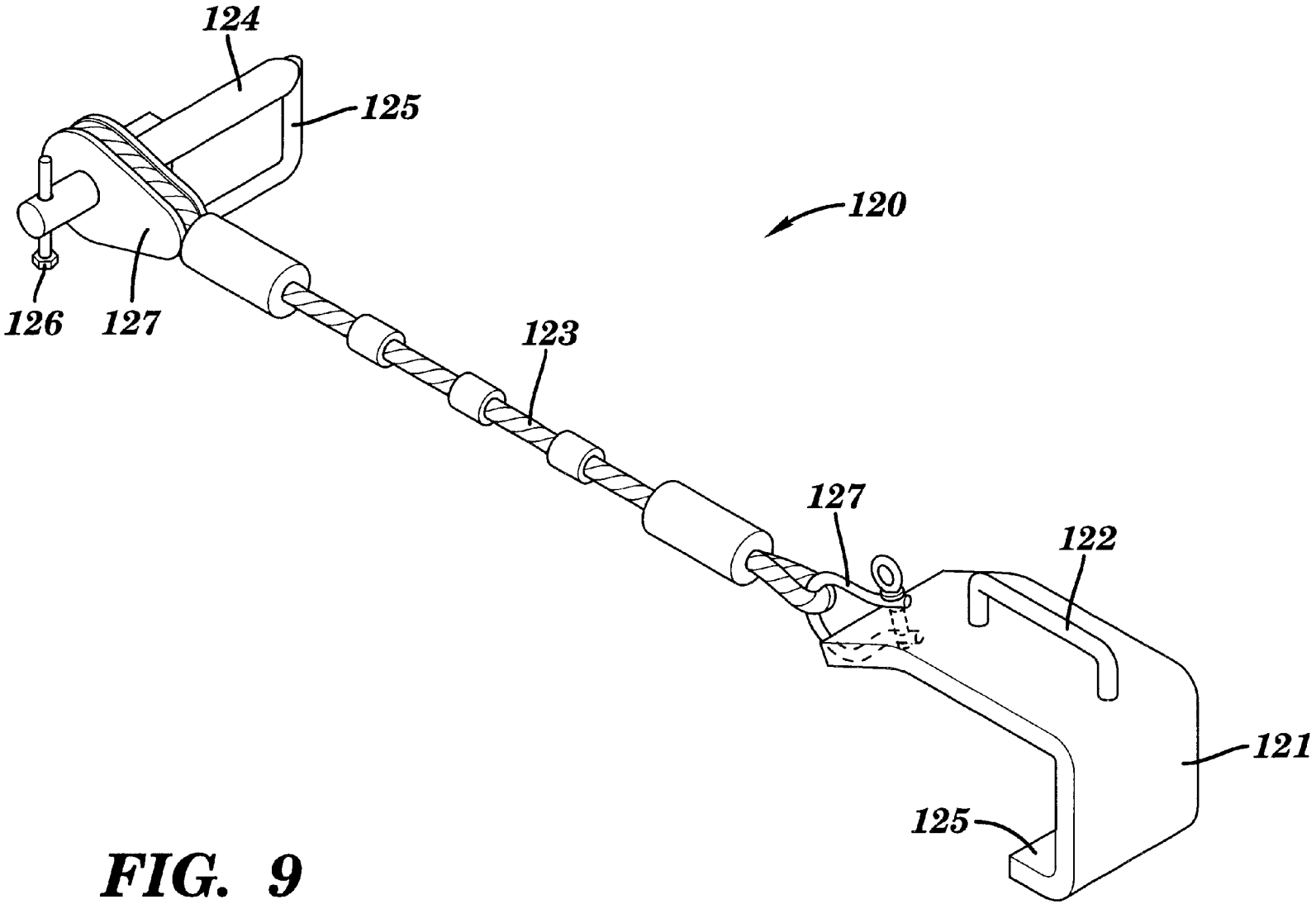
FIG. 9 depicts a perspective view of the hook-cable-connecting pin sub-assembly portion of the rail wheel set extractor apparatus, in accordance with the present invention.

FIG. 9 depicts a perspective view of a hook-cable-connecting pin sub-assembly 120, in this case, removed from the rest of the rail wheel extractor apparatus 100, in accordance with the present invention. The hook-cable-connecting pin sub-assembly 120 acts as an attachment or grabbing system for holding or grabbing a portion of a rail wheel 40. The cable 123 terminates at either end with cable eyes 127. Attached to the eye 127 on one end of the cable 123 is a hook 121. The hook 121 is a holding or grabbing device for holding or grabbing the rail wheel 40. A hook handle 122 is attached to, or formed as part of, the hook 121. Attached to the eye 127 at the other end of the cable 123 is a connecting pin 124, which similarly has a connecting pin handle 125 which is attached to, or formed as part of, the connecting pin 124. At one end of the connecting pin 124, is a hole and corresponding cotter pin 126 which prevents inadvertent removal of the connecting pin 124. The connecting pin 124 can have a notch which corresponds with a key in the holes 113 on the frame uprights 112. The notch both prevents rotation of the connecting pin 124 and ensures uniform insertion of the connecting pin 124.

The present invention improves the method of extracting, changing, and transporting a rail wheel set 50 by significantly saving steps, time, equipment, manpower, and ultimately cost. In order to extract or remove a rail wheel set 50 with the present invention the whole truck 20 does not have to be disconnected from the rail car 10 at the center plate 23. Additionally, the rail car 10 does not have to be lifted or jacked as high above the rails 5 as in the current practice. Also, in particular for the inboard wheel sets 50 (e.g., See 50B, 50C of FIG. 1), the wheel sets 50 can be extracted while still physically under the rail car 10, albeit disconnected from the rail car 10, with the present invention. Additionally, there are no chains or slings required to lift and move the wheel set 50 once the wheel set 50 is held by the rail wheel set extractor apparatus 100 of the current invention.

Figure 10:
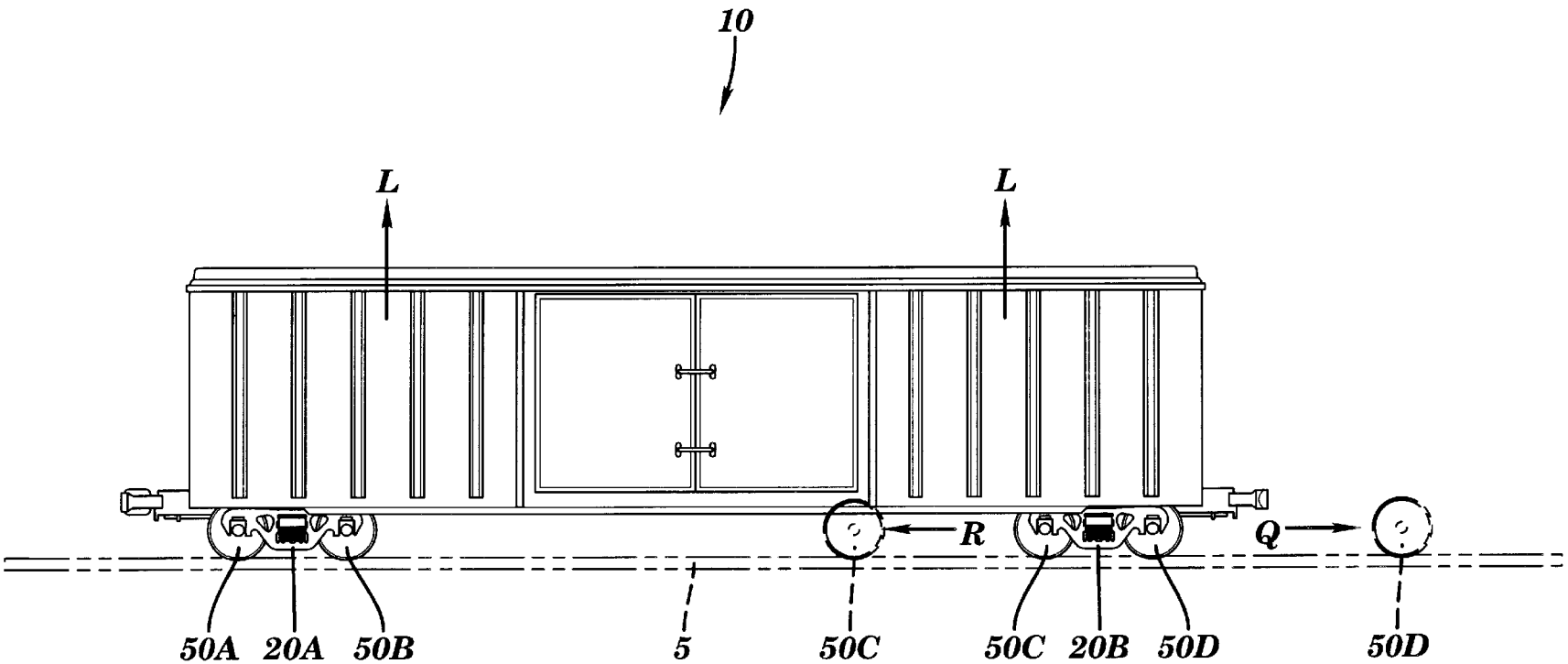
FIG. 10 depicts a side view of the typical steps for removing a rail wheel set from a freight box-car, in accordance with the present invention.

FIG. 10 depicts the beginning method steps of the current invention. A typical freight box car 10 rests on rails 5 (shown in phantom). As with a typical freight box car 10, there are two trucks 20A, 20B and four wheel sets SA, 50B, 50C, 50D. In FIG. 10 either of the two wheel sets 50C, 50D from the truck 20B are selected for extraction. Either the inboard wheel set 50C, or outboard wheel set 50D is disconnected from the truck 20B. Then the rail car 10 is lifted or jacked up (denoted by directional arrows "L") such that the rail wheel set 50, bearings, etc. clear vertically the truck pedestals 24 (not shown) so that the rail wheel set 50 can be rolled clear of the truck 20B. In the case of the outboard wheel set 50D, the wheel set 50D is rolled beyond the ends of the rail car 10 (denoted in phantom and by directional arrow "Q"). In the case of the inboard wheel set 50C, the wheel set 50C need only be rolled towards the interior or middle area of the rail car 10 away from the wheel truck 20B (Denoted in phantom and by directional arrow "R"). That is, an inboard rail wheel set 50C may still be underneath the rail car 10 in order to be extracted. Once the respective wheel set 50 is free from the rail car 10 and truck 20, an operator is able to use the rail wheel set extractor apparatus 100 of the present invention to extract the disconnected rail wheel set 50. Note that for several types of rail vehicles, such as intermodal cars or articulated cars, there may be a plurality of inboard rail wheel sets 50 that benefit from the use of this method of rail wheel set 50 extraction.

Figure 11:
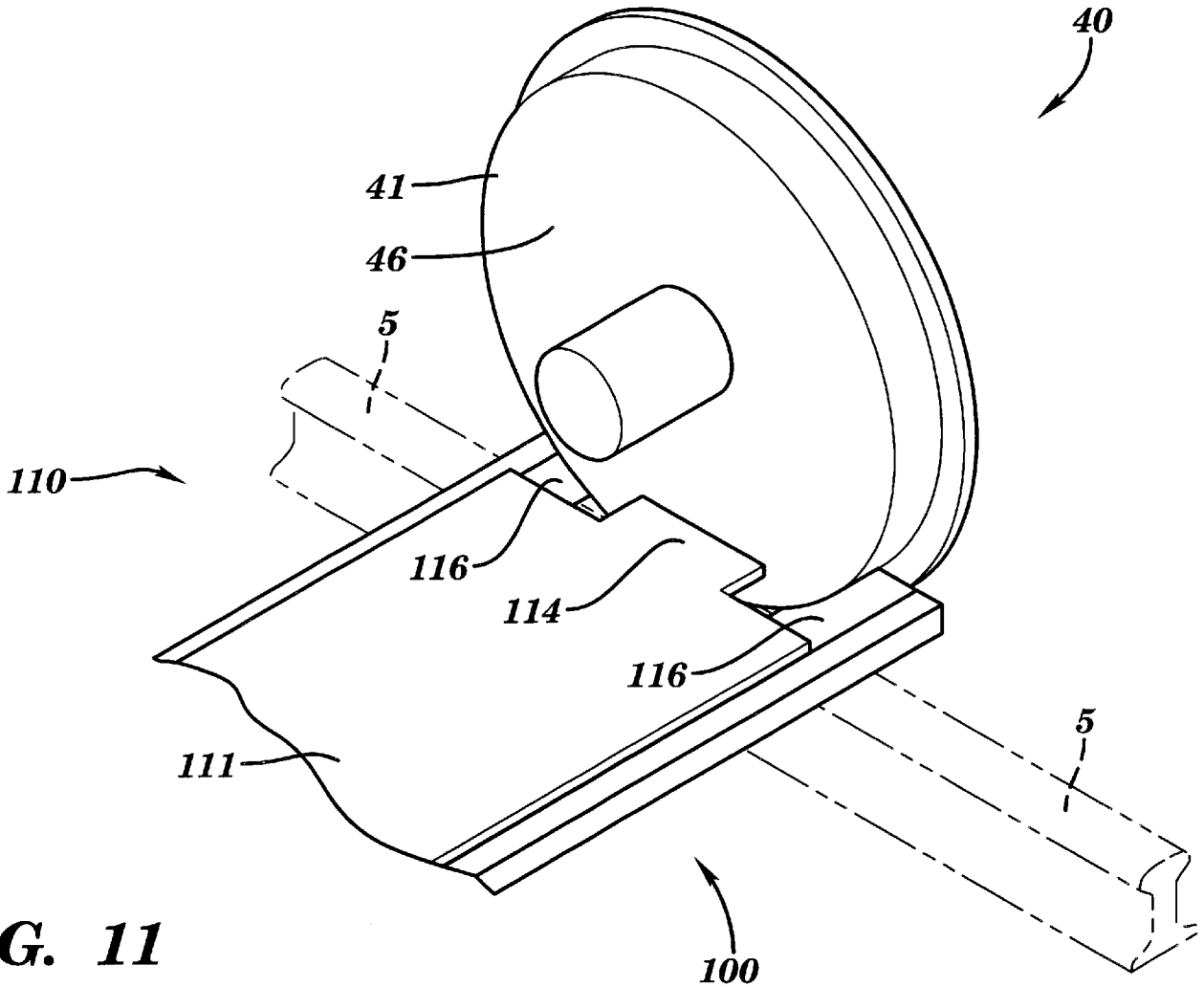
FIG. 11 depicts a perspective view of the engagement of the center member and support system of the rail wheel set extractor apparatus to a rail wheel, in accordance with the present invention.

Once a rail wheel set is free from its attachment to the truck 20 and rail car 10, the rail wheel set extractor apparatus 100 is moved in place adjacent to the outside face 46 of either rail wheel 40. The rail wheel set extractor apparatus 100 can be moved and positioned by a lifting device 130, such as a fork lift or other piece of fixed or mobile equipment. In accordance with the present invention, FIG. 11 depicts the next step of using the rail wheel set extractor apparatus 100 once it is adjacent to the rail wheel set 50. The frame 110 is placed against the outside of the rail wheel 40 along the lower portion of the wheel 40. The device is placed so that the two side arms 116 are underneath (i.e. straddle) the bottom of the wheel rim 41 and so that the end face of the center member 114 is engaged against, or adjacent to, the plate, fillet or face 46 of the rail wheel 40 adjacent to the rim 41 on the lower portion of the wheel 40. The tread 43 (FIG. 12) of the rim 41 bears directly on the two side arms 116. The two side arms 116 provide a support system and adequate purchase to the wheel 40 so that when a lifting device 130 is applied to the rail wheel set extractor apparatus 100, the wheel 40 and whole wheel set 50 can be lifted off the rail 5 (shown in phantom). The center member 114 provides a mechanism to prevent rotation and movement to the rail wheel 40 both while the wheel 40 is at rest on the rail 5 and later while the wheel 40 and wheel set 50 are being lifted and transported by the lifting device 130.

Figure 12:
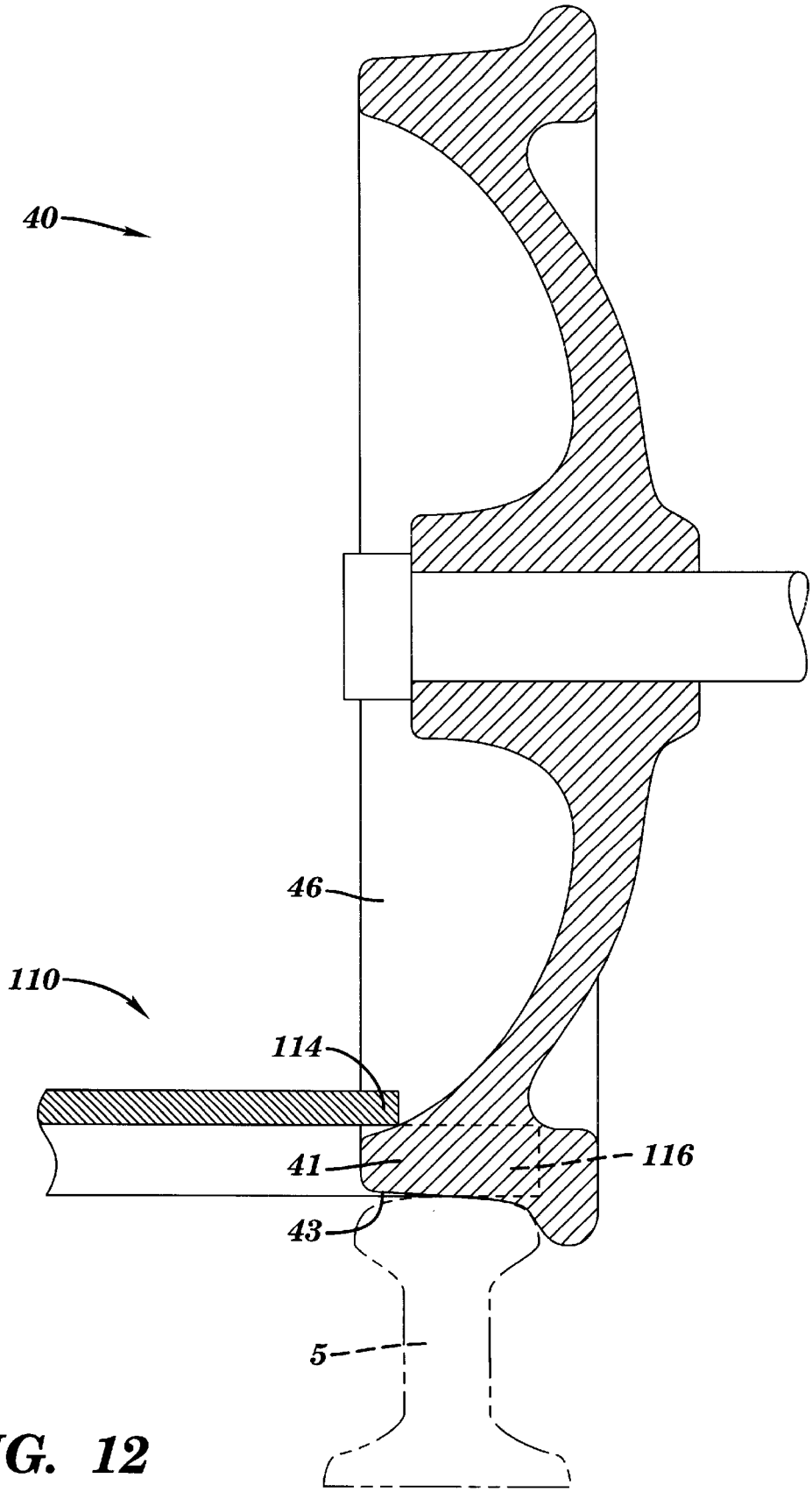
FIG. 12 depicts a partial cross-sectional, cut-away view of the center member and support system of the rail wheel set extractor apparatus engaged with a rail wheel, in accordance with the present invention.

FIG. 12 depicts a partial cross-sectional, cut-away view of the frame 110 engaged with a rail wheel 40, in accordance with the present invention. The tread 43 of the rail wheel 40 rests directly on the rail 5 (shown in phantom). The center member 114 is engaged against the plate, face or fillet 46 of the rail wheel 40. The center member 114 can also be engaged with the rim 41 of the rail wheel 40. The outer edge of the center member 114 can be flat. The outer edge of the center member 114 can also be curved in either the vertical or horizontal direction in order to be contoured to adapt to the curved plate, face or fillet 46 of the rail wheel 40. The center member 114 can act alone in preventing rotation and movement of the rail wheel 40, or in combination with the two side arms 116 to prevent the rotation and movement of the rail wheel 40. While one center member 114 is shown, there may be a plurality of center members 114 to prevent rotation and movement of the rail wheel 40. Similarly, the side arms 116 can also be shaped and curved in the vertical and horizontal direction in order to be contoured to adapt to the curved shape of the tread 43 of the wheel 40.

Figure 13:
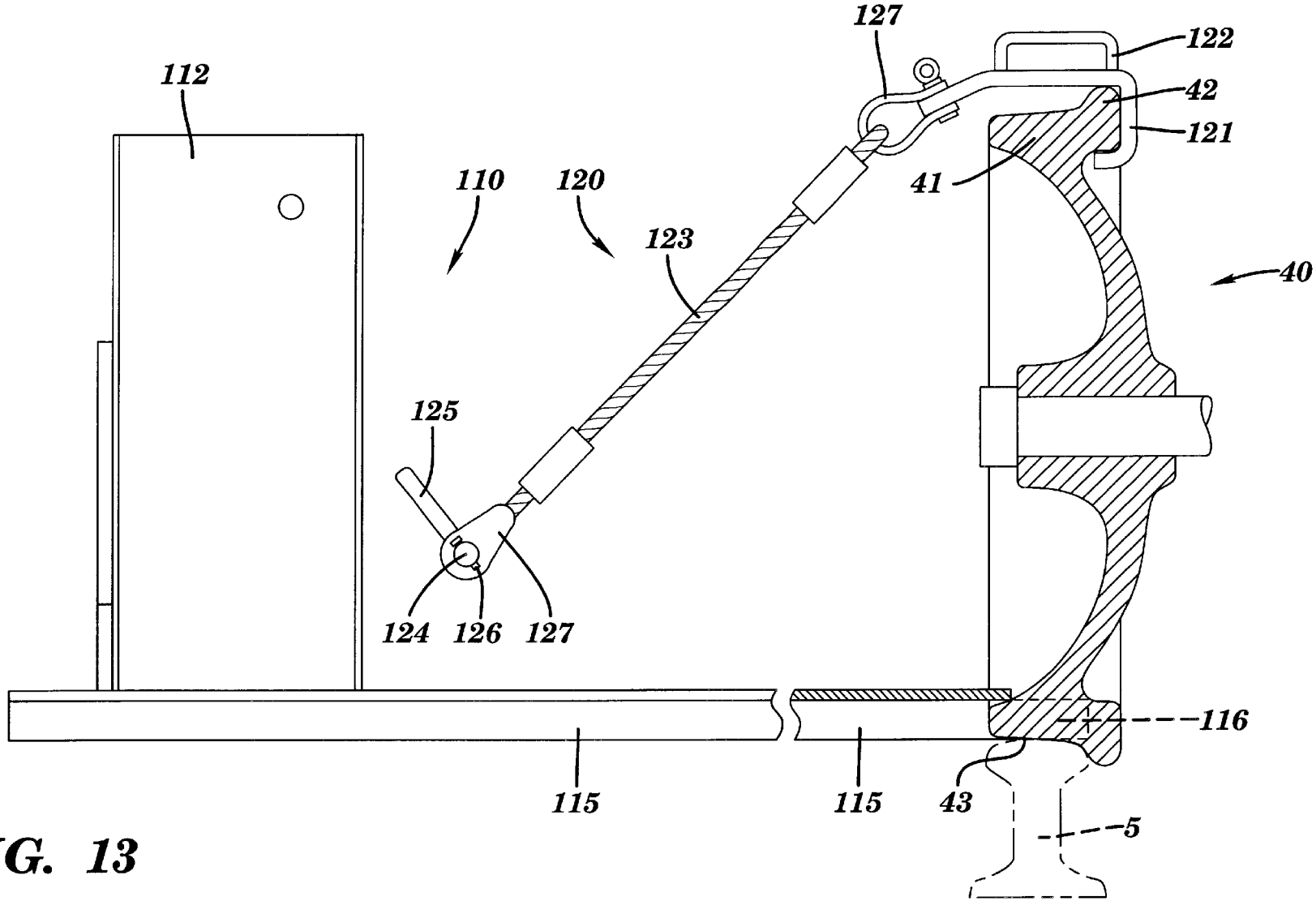
FIG. 13 depicts a side view of the engagement of an attachment system of the rail wheel set extractor apparatus to a rail wheel, in accordance with the present invention.

FIG. 13 depicts a side view of the rail wheel extractor apparatus 100 during the next step of the method, in accordance with the present invention. The next step is to take the hook-cable-connecting pin sub-assembly 120 which is, at this point, separated from the frame 110. The hook 121, of the hook-cable-connecting pin sub-assembly 120, is placed over the top rim 41 of the rail wheel 40 so that it is hooking towards the inboard side of the rail wheel 40. Thus, the hook 121 is engaged on the inboard side of the wheel flange 42 and rim 41. The hook 121 serves to hook, grab, or attach to the rail wheel 40. A hook handle 122 on the hook 121 can facilitate the user with placing the hook 121. The fork tubes 115 enable a fork-lift or other lifting device 130 to lift, position, and transport the rail wheel set extractor apparatus 100. The rail 5 is shown in phantom.

Figure 14:
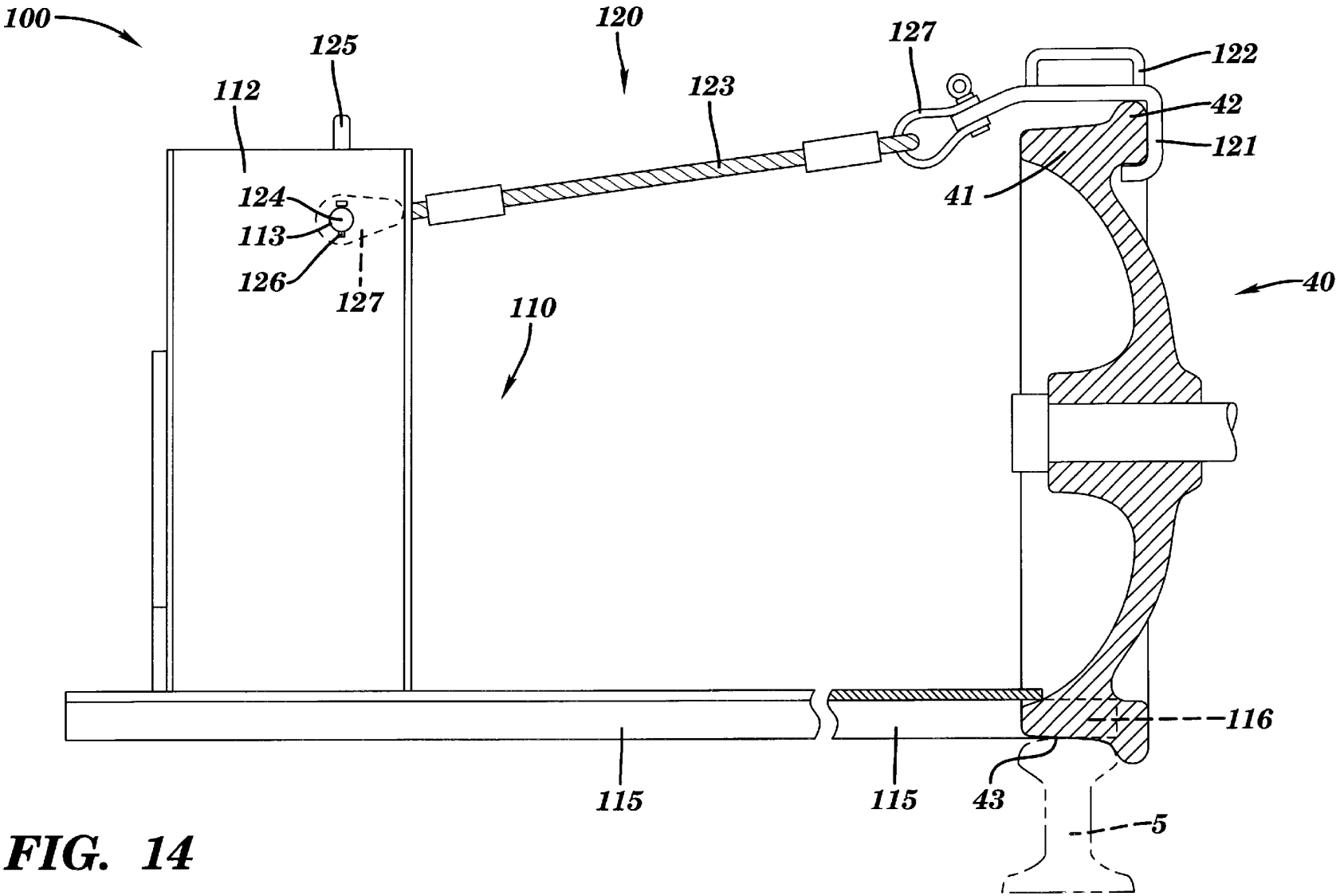
FIG. 14 depicts a side view of the engagement of a connecting pin to the frame uprights, in accordance with the present invention.

FIG. 14 depicts a side view of the rail wheel extractor apparatus 100 in the next step of the method, in accordance with the present invention. As shown in FIG. 14, once the hook 121 is engaged on the wheel rim 41 and flange 42, the connecting pin 124 at the other end of the cable 123 is placed through one of the holes 113 in the frame uprights 112, through the eye 127 in the end of the cable 123, and then through the other hole 113 in the other frame upright 112, thereby connecting the hook-cable-connecting pin sub-assembly 120 to the frame 110 of the rail wheel set extractor apparatus 100. A connecting handle 125 can facilitate the insertion of the connecting pin 124. Finally, a cotter pin 126 is placed through a hole in the connecting pin 124 to prevent any inadvertent removal or slippage of the connecting pin 124 out of the upright holes 113 and cable eye 127. The hook 121 and hook-cable-connecting pin sub-assembly 120 once connected back up with the frame 110 provides an attachment system or grabbing system for holding or grabbing the rail wheel 40 and wheel set 50 off of the rail 5 (shown in phantom). Once these steps are completed, the wheel set 50 is prepared for lifting and transport.

Figure 15:
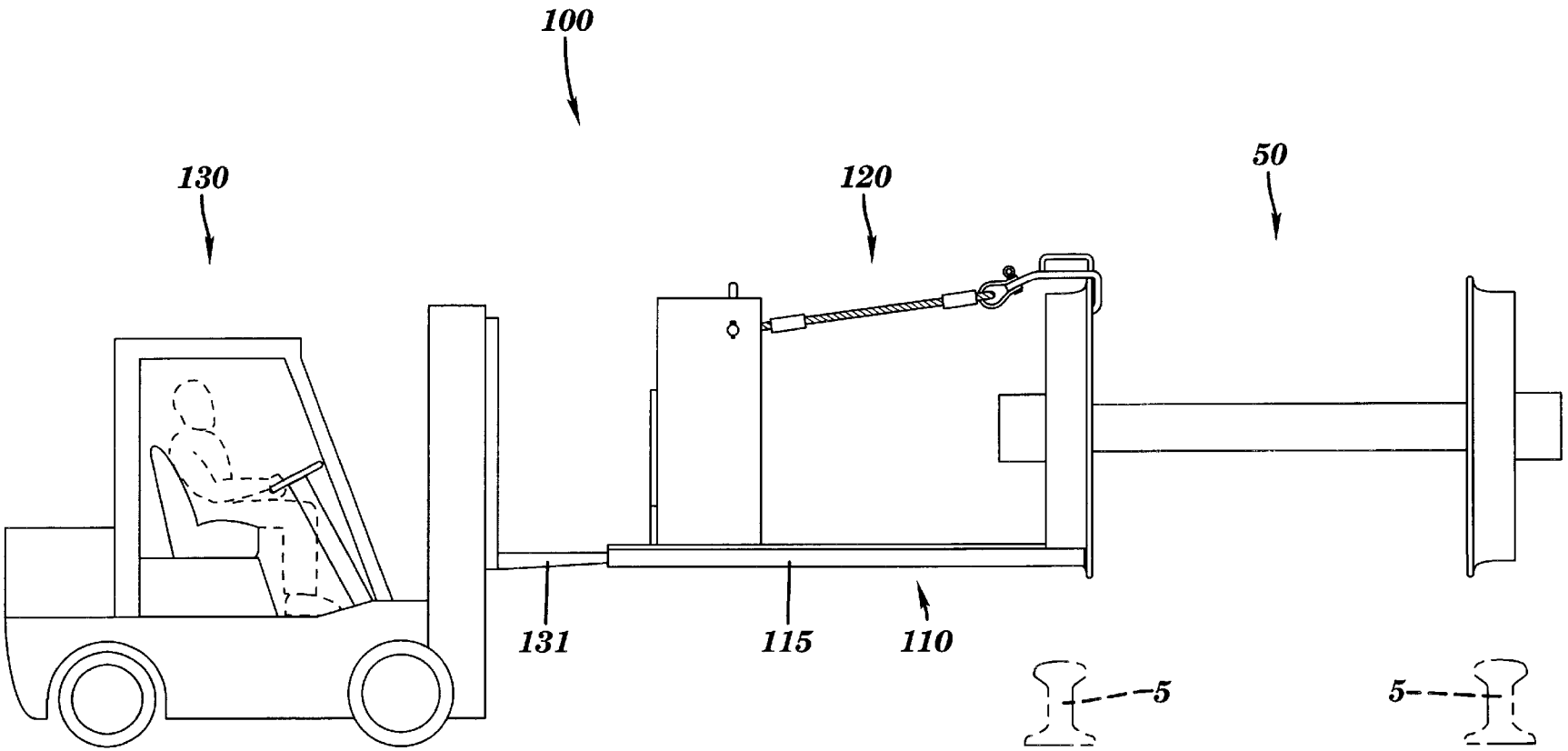
FIG. 15 depicts the application of the lifting device of the rail wheel set extractor apparatus, in accordance with the present invention; and, FIG. 16 depicts a side view of an embodiment of the apparatus with a hydraulic-assisted mechanical arm, in accordance with the present invention.

FIG. 15 depicts a side view of the rail wheel set extractor apparatus 100 with a lifting device 130 being applied thereto, in accordance with the current invention. The wheel set 50 while engaged to the rail wheel set extractor apparatus 100 can be extracted, lifted, moved, transported, and even returned to a rail car 10 and truck 20. The lifting device 130 can be provided by various devices. In one embodiment attached to the underside of the base plate 111 are two steel tubes 115 which are sized and configured so that the forks 131 on a forklift 130 or other equipment with lifting forks 131 can fit within the tubes 115. Thus, in the embodiment the rail wheel set extractor apparatus 100 is lifted, once attached to a wheel set 50, via a forklift 130 off of the rails 5, as shown in FIG. 13. Other lifting devices 130 include a boom truck, a front end loader with forks attached to the scoop, and other pieces of mobile equipment. The lifting equipment could be either rail mounted, on rubber tires or tracks, or even a fixed piece of equipment in the case of a wheel set changing station in a rail repair shop or yard. The lifting device 130 can either be fixed to the rail wheel set extractor apparatus 100 or removably attached. Additionally, the lifting device 130 could be self contained with the frame 110 and rest of the rail wheel set extractor apparatus 100.

Alternative embodiments are contemplated for the hook-cable-connecting pin sub-assembly 120. For example, in lieu of a cable 123 the hook-cable-connecting pin sub-assembly 120, can have any other suitable connecting mechanism including a chain, rod, rope, carbon fiber, etc. Alternatively, the hook 121 could be removably or permanently attached to the frame 110. Also, in lieu of a cable 123, the hook-cable-connecting pin sub-assembly 120, which is an attachment system for the wheel 40, could be comprised of a mechanical arm which could be pneumatically or hydraulically assisted.

Figure 16:
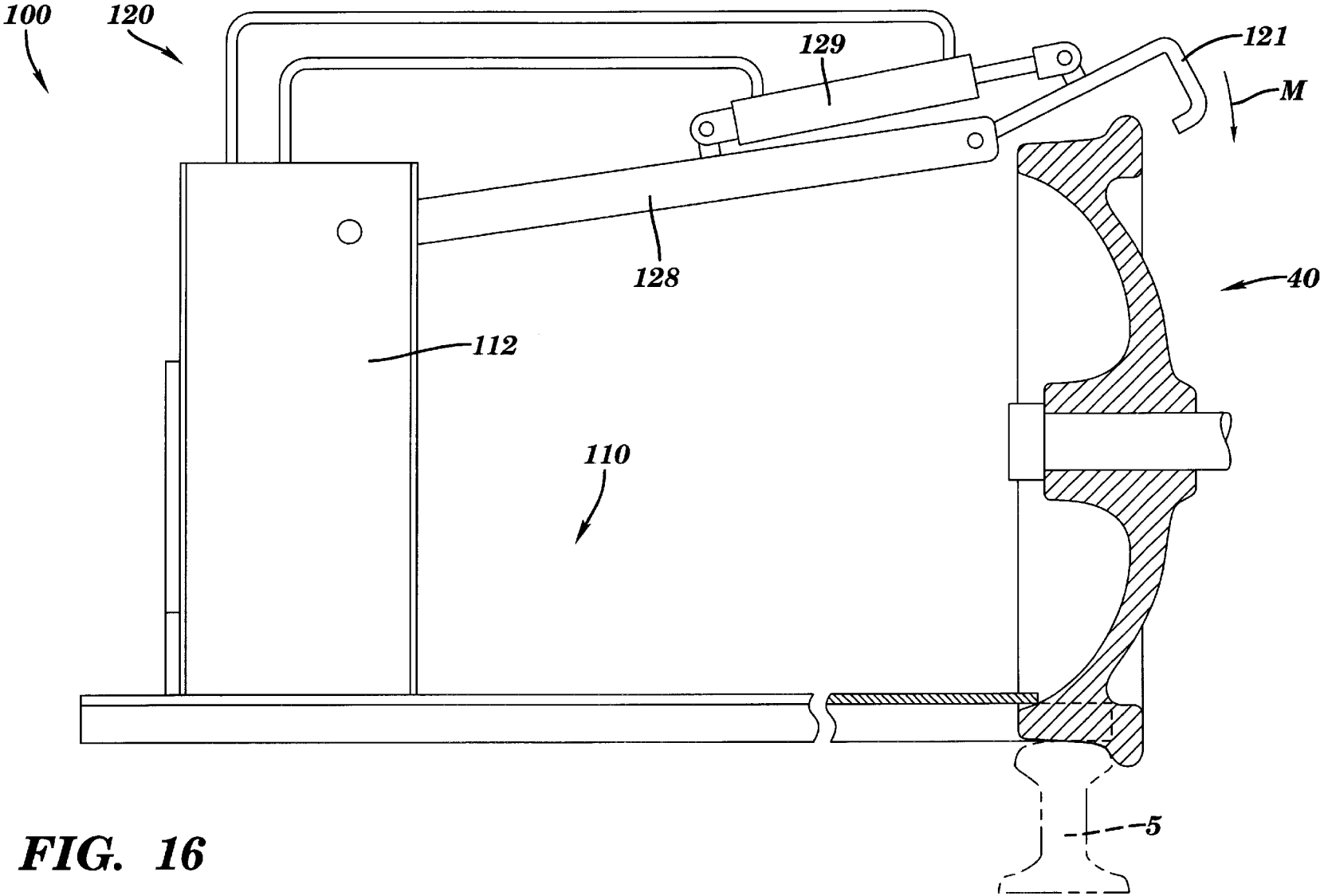

FIG. 16 depicts a side view of an alternative embodiment of the rail wheel extractor apparatus 100 with a hydraulic-assisted mechanical arm as the attachment system 120. As shown in FIG. 16, in lieu of the hook-cable-connecting pin sub-assembly 120 is a hydraulically assisted mechanical arm that includes a hook 121, a lower arm 128, and a pneumatic system 129. The mechanical arm 120 is fixed or rotatably attached to the uprights 112. The hook 121 can rotate in relation to the lower arm 128 (denoted by directional arrow "M"). The lower arm 128 can rotate in relation to the uprights 112 (not shown). The pneumatic system 129 is attached to both the hook 121 and lower arm 128. The pneumatic system 129 provides the force to rotate the hook 121. The hook 121 which is rotatably attached to the lower arm 120, may be engaged on the wheel 40. The hook 121 and lower end 128 provide an attachment system or grabbing system for holding or grabbing the rail wheel 40 and wheel set 50 off of the rail 5 (shown in phantom).

Additionally, in lieu of a single hook-cable-connecting pin sub-assembly 120, the rail wheel set extractor apparatus 100 could have two or more sub-assemblies 120 thereby providing a redundancy to the device's wheel holding capability.

Although the disclosed embodiment relates to a typical freight box-car 10 with two trucks 20 and four wheel sets 50, the present invention could be configured for any vehicle with rail wheels 40. For example, the device could be used on a locomotive, subway car, gondola car, any type of freight car, railed people movers, articulated car, an intermodal rail car, etc. With intermodal and articulated rail cars in particular, which have a plurality of trucks and wheel sets, the rail wheel set extractor apparatus and method can save significant time and steps in extracting a wheel set. Currently, intermodal and articulated rail cars requires complete disassembly of the various multiple rail car sections to access wheel sets. The invention does not require this said disassembly, in particular, for access to the plurality of inboard wheel sets 50.

Additionally, while the disclosed embodiment discloses a center member 114 that is integral to the base plate 111 of the frame 110, alternative embodiments could have the center member 114 elsewhere on the apparatus 100. The center member 114 could be located so as to engage the rail wheel 40 at various locations on the rail wheel 40. For example, the center member 114 could be integrated with the hook 121 on the hook-cable-connecting pin sub-assembly 120. Alternatively, the center member 114 could engage against the wheel plate, fillet or face 46 on other portions of the wheel 40. The center member 114 provides stability to the wheel 40 while it is being lifted and transported. Because the center member 114 prevents rotation and movement, in any direction, of the rail wheel 40, its location could be altered so long as to maintain its functionality.

Although the rail wheel set extractor apparatus of the present invention described above describes a method and steps in the removal of a rail wheel set 50, it should be clear to one of ordinary skill in the art that the rail wheel set extractor apparatus of the present invention is also useful for the reinstallation of a rail wheel set onto a truck 20, and other uses. In addition, the rail wheel set extractor apparatus of the present invention when connected to a lifting means 130 is useful in the transporting or movement of a rail wheel 40 or rail wheel set 50.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. An apparatus for extracting a rail wheel set comprising:

a frame with a support system adapted to straddle a bottom portion of only a single rail wheel of the rail wheel set;

an attachment system adapted to operatively attach the frame to the rail wheel; and a member adapted to prevent rotation and movement of the rail wheel set.

2. An apparatus as in claim 1 wherein:

the support system comprises two side arms.

3. An apparatus as in claim 1 wherein:

the attachment system holds the rail wheel.

4. An upparatus as in claim 3 wherein:

the attachment system holds a rim of the rail wheel.

5. An apparatus as in claim 4 wherein:

the attachment system comprises at least one hook.

6. An apparatus as in claim 5 wherein:

the at least one hook is removably attached to the frame.

7. An apparatus as in claim 1 wherein:

the attachment system includes a hydraulic-assisted arm.

8. An apparatus as in claim 1 wherein:

the member is engageable with a face of the rail wheel.

9. An apparatus as in claim 1 wherein:

the member is engageable with the face of a lower portion of the rail wheel.

10. An apparatus as in claim 1 wherein:

the frame includes tubes adapted to receive the fork of a fork-lift.

11. An apparatus for extracting a rail wheel set comprising:

a frame attached to a lifting device;

a grabbing system attached to the frame for grabbing a rim on a rail wheel of the rail wheel set;

two side arms adapted to straddle a bottom portion of the rail wheel; and, a center wheel locking member engageable with a face of the rail wheel.

12. An apparatus as in claim 11 wherein:

the lifting device is selected from the group consisting of a front-end loader, a fork lift, and a boom.

13. An apparatus as in claim 11 wherein:

the lifting device is rail mounted.

14. An apparatus as in claim 11 wherein:

the lifting device is removably attached to the frame.

15. An apparatus as in claim 11 wherein:

the frame includes tubes adapted to receive the forks of a fork-lift.

* * * * *